US005635869A

United States Patent [19]

Ferraiolo et al.

[11] Patent Number: 5,635,869

[45] Date of Patent: Jun. 3, 1997

[54] CURRENT REFERENCE CIRCUIT

[75] Inventors: Frank D. Ferraiolo, Essex Junction; John E. Gersbach, Burlington; Ilya J. Novof; Edward J. Nowak, both of Essex Junction, all of Vt.

[73] Assignee: International Business Machines Corporation

[21] Appl. No.: 536,222

[22] Filed: Sep. 29, 1995

[51] Int. Cl.[6] ..... G05F 1/10

[52] U.S. Cl. ..... 327/543; 327/538; 327/103

[58] Field of Search ..... 327/535, 538–543, 327/103; 323/312, 313, 315; 330/288

[56] References Cited

U.S. PATENT DOCUMENTS

| | | | |
|---|---|---|---|
| 3,875,430 | 4/1975 | Prak | 307/297 |
| 4,010,425 | 3/1977 | Dingwall et al. | 327/535 |
| 4,442,398 | 4/1984 | Bertails et al. | 327/535 |
| 4,471,292 | 9/1984 | Schenck et al. | 327/535 |
| 4,618,815 | 10/1986 | Swanson | 330/288 |
| 4,629,972 | 12/1986 | Briner et al. | 323/314 |
| 4,646,220 | 2/1987 | Dao | 363/28 |
| 4,745,079 | 5/1988 | Pfiester | 437/29 |
| 4,792,750 | 12/1988 | Yan | 323/315 |
| 4,970,415 | 11/1990 | Fitzpatrick et al. | 307/448 |
| 5,221,864 | 6/1993 | Galbi et al. | 327/535 |

*Primary Examiner*—Toan Tran

*Attorney, Agent, or Firm*—William P. Skladony; Andrew J. Dillon

[57] ABSTRACT

A constant-current generator circuit includes an output circuit and a control circuit, with the control circuit producing a control voltage to define a reference current through the output circuit. An important feature is that the control circuit uses a pair of transistors having different threshold voltages in generating the control voltage. The circuit is formed using CMOS technology, and the difference in threshold voltage may be produced by doping the polysilicon gate of an N-channel or P-channel field effect transistor. The step of doping to produce the change in threshold voltage is compatible with the standard processing for the CMOS device. In a preferred embodiment, the control circuit uses two pairs of control transistors, each pair having differing thresholds. One pair is P-channel and the other N-channel. These pairs are in parallel, the P-channel pair connected to the positive supply and the N-channel pair to the negative supply or ground. Each pair is connected in a cascode arrangement, producing two control voltages for two symmetrical output transistors in the output circuit, one N-channel and one P-channel.

13 Claims, 2 Drawing Sheets

CURRENT REFERENCE CIRCUIT

BACKGROUND OF THE INVENTION

1. Technical Field

This invention relates to transistor circuits for supplying constant current, and more particularly to a circuit using CMOS transistors of varying threshold voltages to provide a constant current source in an integrated circuit device.

2. Description of the Related Art:

In high speed integrated circuit devices such as microprocessors or application specific (ASIC) circuits, it is often desired to use a constant current supply in high speed logic circuits such as PLL, for example. It has been the practice to employ devices other than standard CMOS field-effect transistors to generate reference levels in these constant current sources. For example, p-n junction diodes or resistors, or combinations of these two, have been utilized for this purpose. The p-n junction diode would be formed by a P+ diffusion in an N-well, in one example. However, a CMOS process may not be compatible with use of a diode formed in this manner, because the shallow-diffusion p-n junction diodes may have a tendency to develop parasitic Schottky diodes in parallel with the p-n junction diode, resulting in creation of a large variation in the voltage drop across the diode structure and a high level of leakage. In addition to these problems with parasitic effects, the creation of analog components such as p-n junction diodes and resistors, i.e., components other than the standard CMOS P-channel and N-channel transistors, increases the process cost because additional steps must be added to the manufacturing method, and these additional steps not only add to the time and actions needed to complete the wafer processing, but also usually have a negative effect on yields. Accordingly, it would be preferable to provide a referen without using p-n junction diodes of this type, in a standard CMOS process.

Another factor in providing a current reference in a CMOS integrated circuit is the need to have the circuit exhibit a selected temperature coefficient. It is desirable that the device be relatively insensitive to temperature. The response of the current reference is a significant factor in overall system responsiveness to temperature. It is preferred that the current reference circuit be able to be adjusted in its temperature coefficient without major process revisions, i.e., that the adjustment be made without introducing steps in the process that are major variations from the standard process.

SUMMARY OF THE INVENTION

It is therefore one object of the present invention to provide an improved method of creating a constant current source.

It is another object of the present invention to provide an improved constant current circuit which uses components which are compatible with digital CMOS process technology without generating unwanted parasitic effects.

It is yet another object of the present invention to provide a constant current circuit which does not require special type components such as p-n junction diodes or resistors.

It is a further object of the present invention to provide a constant current circuit which is easily adjustable in temperature coefficient, i.e., without major process changes in a CMOS manufacturing method.

The above as well as additional objects, features, and advantages of the present invention will become apparent in the following detailed written description.

According to one embodiment of the invention, a constant-current generator circuit includes an output circuit and a control circuit, with the control circuit producing a control voltage to define a reference current through the output circuit. An important feature is that the control circuit uses a pair of transistors having different threshold voltages in generating the control voltage. The circuit is formed using CMOS technology, and the difference in threshold voltage may be produced by doping the polysilicon gate of an N-channel or P-channel field effect transistor. The step of doping to produce the change in threshold voltage is compatible with the standard processing for the CMOS device. In a preferred embodiment, the control circuit uses two pairs of control transistors, each pair having differing thresholds. One pair is P-channel and the other N-channel. These pairs are in parallel, the P-channel pair connected to the positive supply and the N-channel pair to the negative supply or ground. Each pair is connected in a cascode arrangement, producing two control voltages for two symmetrical output transistors in the output circuit, one N-channel and one P-channel.

BRIEF DESCRIPTION OF THE DRAWINGS

Certain novel features which are believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF PREFERRED EMBODIMENT

Figure 1:
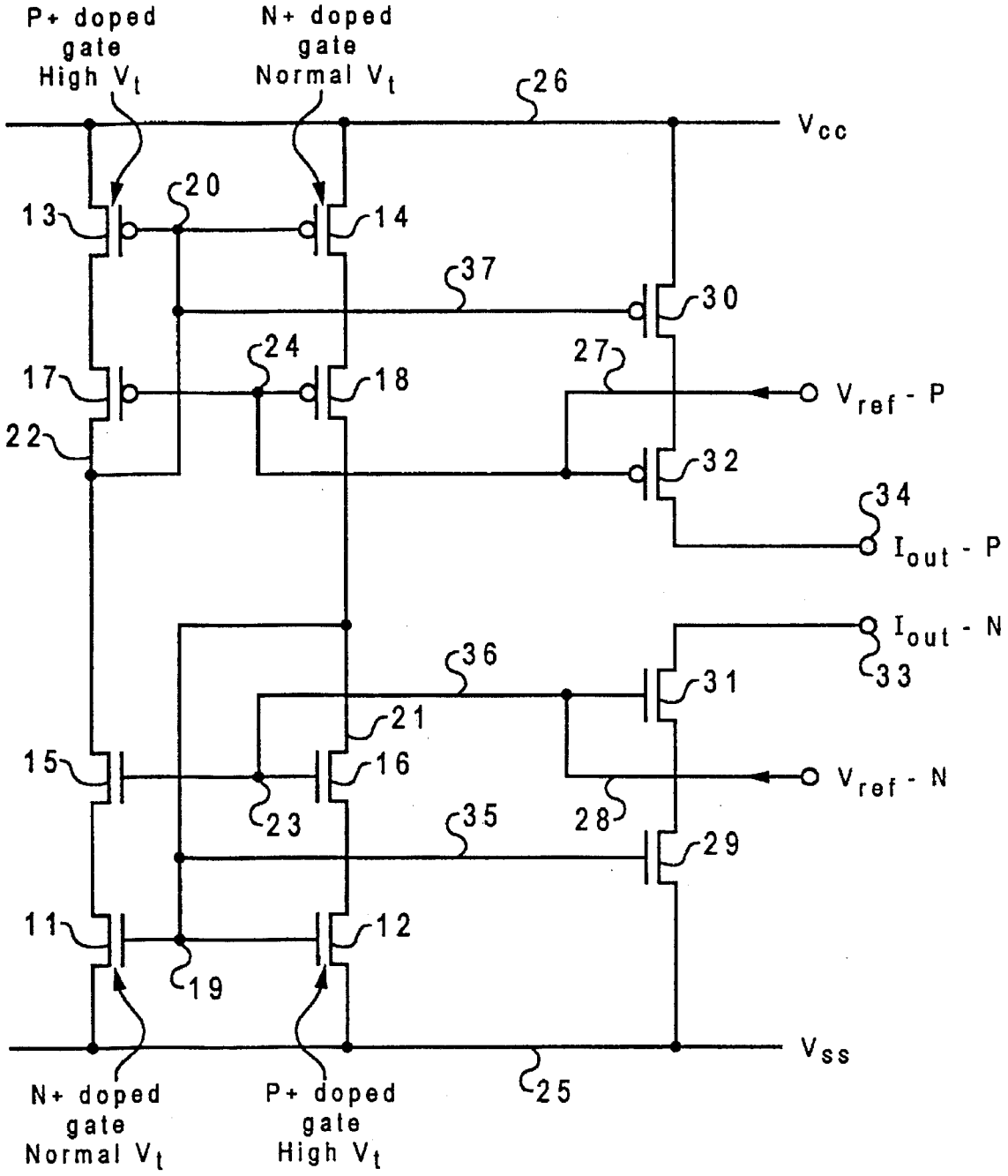
FIG. 1 is an electrical schematic diagram of a constant current circuit which is constructed using features of one embodiment of the present invention.

Referring to FIG. 1, a current reference circuit 10 is illustrated according to one embodiment of the invention, using pairs of P-channel and N-channel polysilicon-gate field-effect transistors. The transistors are doped to provide certain relative threshold voltages or $V_t$'s. The first pair includes N-channel transistors 11 and 12, where the transistor 11 has its polysilicon gate doped N+ (the normal process) and so it exhibits a normal $V_t$, while the transistor 12 has its polysilicon gate doped P+ and exhibits a high $V_t$. The P+ doped poly gate N-channel transistor 12 has a threshold voltage about 1.05 V higher than that of the normal N-channel transistor 11; this voltage difference is close to the band gap voltage of silicon, and it is due to the difference in the work function of the gate materials—the tolerance is very good for the CMOS process and is about 3%, the best tolerance available in digital CMOS process. The second pair includes P-channel transistors 13 and 14, where the transistor 13 has its poly gate doped P+ and exhibits a high $V_t$, while the transistor 14 has its poly gate doped N+ (the normal process) and so it exhibits a normal $V_t$. The first pair has a pair of N-channel cascode transistors 15 and 16, and the second pair has a pair of P-channel cascode transistors 17 and 18. The gates of the first pair of N-channel N+ and P+ doped transistors 11 and 12 are connected together at a node 19, and the gates of the second pair of P-channel N+ and P+ doped transistors 13 and 14 are connected together at a node 20. The gate node 19 for the N-channel pair is connected to the drain 21 of the N-channel transistor 16, and the gate node 20 for the P-channel pair is connected to the drain 22 of the P-channel transistor 17. The gates of the cascode transistors 15 and 16 for the first pair of N-channel N+ and P+ doped transistors 11 and 12 are connected together at a node 23, and the gates of the cascode transistors 17 and 18 for the second pair of P-channel N+ and P+ doped transistors 13 and 14 are connected together at a node 24. The sources of the first pair of N-channel N+ and P+ doped transistors 11 and 12 are connected to one side of a voltage supply, in this case ground or $V_{ss}$ line 25. The drains of the second pair of P-channel N+ and P+ doped transistors 13 and 14 are connected to the other side of the voltage supply, a $V_{cc}$ line 26. The circuit 10 including the pairs of P+ doped and N+ doped polysilicon-gate field-effect transistors as connected as seen in FIG. 1 functions as a pair of current mirror devices.

According to the invention, because of the threshold voltage difference between the N-channel transistors 11 and 12, the extra overdrive voltage is applied across the normal-$V_t$ transistor 11; this extra overdrive voltage is constant and equal to about 1.05 V. By choosing the appropriate width-to-length ratios of transistor 11 and 12, a predetermined output current will be established in the N-channel cascoded current mirror consisting of N-channel transistors 11, 12, 15, and 16, and this current will be insensitive to the value of the supply voltage applied between $V_{ss}$ and $V_{cc}$ (and used throughout the chip). Similarly, the P-channel cascoded current mirror consists of P-channel transistors 13, 14, 17 and 18. Because of the threshold voltage difference between transistors 13 and 14, the extra overdrive voltage is applied across the normal $V_t$ transistor 14, and again this extra overdrive voltage is constant and equal to about 1.05 V. And, by choosing the appropriate width-to-length ratios of the transistors 13 and 14, a predetermined output current will be established in the P-channel current mirror.

Reference voltages $V_{ref}$-P on line 27 and $V_{ref}$-N on line 28 are used to raise the output impedance of the current mirrors. These reference voltages are generated on-chip by separate circuits, and are chosen to keep the current mirror transistors just above pinch-off. The reference voltage $V_{ref}$-P on line 27 provides the reference for P-channel cascode transistors 17 and 18 at gate node 24, and the reference voltage $V_{ref}$-N on line 28 provides the reference for N-channel cascode transistors 15 and 16 at gate node 23.

An N-channel output transistor 29 is provided to reflect the current in the transistor 11, and a P-channel output transistor 30 is provided to reflect the current in the transistor 14. A cascode transistor 31 has its source-to-drain path in series with that of the N-channel output transistor 29. Similarly, a cascode transistor 32 has its source-to-drain path in series with that of the P-channel output transistor 30. The amplitude of the output current $I_{out}$-N flowing into node 33 and through N-channel output transistor 29 is dependent upon the relative sizes of the transistors 12 and 29 and the reference current that flows in transistor 12. Similarly, the amplitude of the output current $I_{out}$-P flowing out of the node 34 from P-channel output transistor 30 and its cascode transistor 32 is dependent upon the relative sizes of the transistors 14 and 30 and the reference current that flows in transistor 13. The gate of the N-channel output transistor 29 is connected by line 35 to the node 19 at the gates of the transistors 11 and 12, which is connected to the drain 21 of the transistor 16, providing the first control voltage. The gate of the N-channel cascode transistor 31 is connected by line 36 to the gate node 23 of the transistors 15 and 16. The gate of the P-channel output transistor 30 is connected by line 37 to the gate node 20 and the drain node 22, providing the second control voltage.

Since the circuit of FIG. 1 is bistable, with a valid operating point at zero currents, a separate circuit is used (not shown) to force the currents to be non-zero as power is applied (e.g., by applying a momentary pulse to the gates of the output tranistors).

One example of a set of transistor sizes in a circuit such as that of FIG. 1, according to the invention, is as follows:

| Transistor | Length/Width Ratio |
|---|---|
| 11 | 10/3.25 |
| 12 | 10/3.25 |
| 13 | 10/3.2 |
| 14 | 10/3.2 |
| 15 | 10/1.25 |
| 16 | 10/1.25 |
| 17 | 10/1.2 |
| 18 | 10/1.2 |
| 29 | 10/3.25 |
| 30 | 10/3.2 |
| 31 | 10/3.25 |
| 32 | 10/3.2 |

Figure 2:
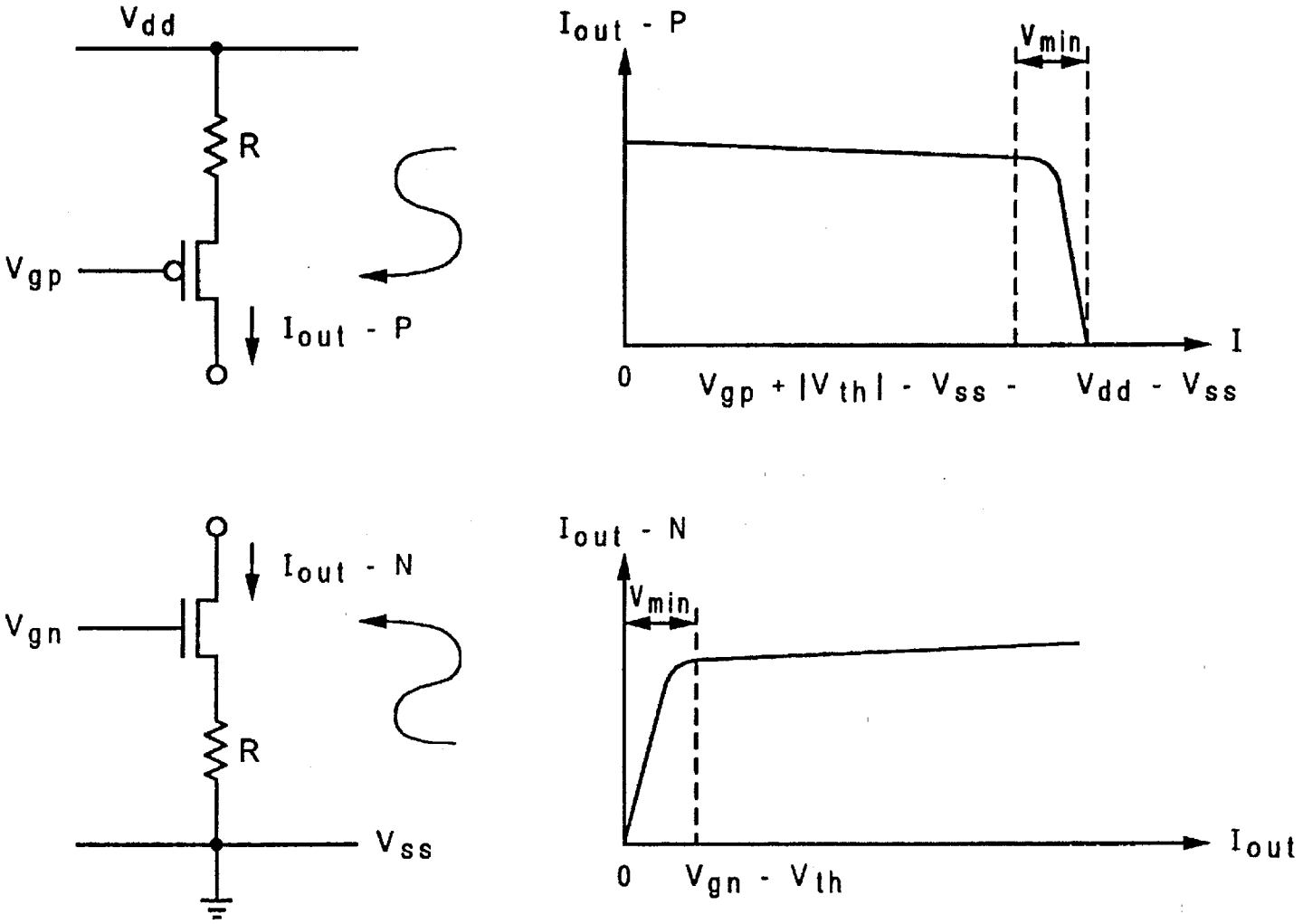
FIG. 2 is a simplified electrical schematic diagram of a constant current circuit as in FIG. 1, with graphs of output current, for explanation of the operating principles.

The construction and operation of circuits for current source functions and current mirror functions is set forth in "CMOS Analog Circuit Design," by Pillip E. Allen and Douglas R. Holberg, pub. by Harcourt Brace Jonanovich College Publishers, at pp. 219–227. In the context of Allen et al., in the circuit of FIG. 1, the output node 33 acts as a current sink, and the output node 34 acts as a current source. A current sink and a current source are two-terminal components whose current at any instant of time is (ideally) independent of the voltage across their terminals. A simplified example of a current sink and a current source constructed using an N-channel and a P-channel field-effect transistor 31 and 32 is seen in FIG. 2, where the output current $I_{out}$-N or $I_{out}$-P is relatively flat for a given gate voltage $V_g$, as seen in the graphs of FIG. 2, if the output voltage $V_{out}$ is above a certain value $V_{min}$ and the gate voltage $V_g$ is held constant. As the output voltage rises above $V_{min}$ (or below, for P-channel), there will be a slight rise in output current, so these are not perfect current sinks or sources. In the relatively flat regions beyond $V_{min}$, the units act as if they had high internal resistance. To reduce the slope of the output characteristic in this region of operation, it is desired to increase the apparent resistance in series with the output, so one way of doing this is to add a series resistor R as seen in FIG. 2. A given increase in voltage at the output node 33 or 34 of FIG. 1 would increase the output current less, with the resistor R present, but this increases power dissipation, requires a lot of space on a chip, and increases the value of $V_{min}$. So, a transistor 31 or 32 (FIG. 1) is added in series (instead of the resistor R), and a bias voltage is applied to the gate node 36 and 27 which may be generated by a divider circuit. This principle uses the common-gate configuration to multiply the source by approximately the voltage gain of the common-gate configuration; the output resistance of the current sink or source should be increased by approximately the common-gate voltage gain of transistor 29 or 30. The current mirror circuits of FIG. 1 perform the function of applying a bias to the gates of the transistors 29, 30, 31, and 32 which has the effect of lowering the $V_{min}$ value, keeping the output transistors in saturation.

While the invention has been particularly shown and described with reference to a preferred embodiment, it will be understood by those skilled in the art that various changes in form and detail may be made therein without departing from the spirit and scope of the invention.

What is claimed is:

1. An integrated circuit, comprising:

a) a constant-current circuit for creating a reference current; and b) a current control circuit connected to said constant-current circuit for generating a control voltage that controls the reference current, the current control circuit including first and second transistors comprising N-channel MOS field effect transistors, said first and second transistors having different threshold voltages, and third and fourth transistors, said third and fourth transistors being P-channel MOS field effect transistors, said third and fourth transistors having different threshold voltages.

2. An integrated circuit according to claim 1 wherein said constant current circuit includes an N-channel driver transistor and a P-channel driver transistor, said N-channel driver transistor having source-to-drain path connected to a first terminal of a voltage supply, said P-channel driver transistor having a source-to-drain path connected to a second terminal of said power supply, and said control circuit applying said control voltage to a gate of said N-channel driver transistor.

3. An integrated circuit according to claim 2 wherein said control circuit applying a second control voltage, that controls the reference current, to a gate of said P-channel driver transistor.

4. An integrated circuit according to claim 3 wherein said control circuit generates said second control voltage from said third and fourth transistors.

5. An integrated circuit according to claim 4 wherein said first and second transistors have polysilicon gates which are doped differently to produce said different threshold voltages.

6. An integrated circuit according to claim 4 wherein said third and fourth transistors have polysilicon gates which are doped differently to produce said different threshold voltages.

7. An integrated circuit according to claim 1 wherein said first and second transistors are field effect transistors having polysilicon gates which are doped differently to produce said different threshold voltages.

8. A constant current generator circuit, comprising:

first and second output transistors, the first output transistor having a source-to-drain path connected in series between a terminal of a voltage supply of one polarity and a first output node, the second output transistor having a source-to-drain path connected in series between a terminal of a voltage supply of opposite polarity and a second output node, a control circuit for generating first and second control voltages for applying to gates of said first and second output transistors, respectively;

said control circuit including first and second control transistors for generating said first control voltage, said first and second control transistors having different threshold voltages, and said control circuit also including third and fourth control transistors for generating said second control voltage, said third and fourth control transistors having different threshold voltages.

9. A constant current generator circuit according to claim 8, wherein said first and second control transistors have source-to-drain paths connected in parallel between said terminal of a voltage supply of one polarity and first and second central nodes, respectively.

10. A constant current generator circuit according to claim 9, wherein said third and fourth control transistors have source-to-drain paths connected in parallel between said terminal of a voltage supply of opposite polarity and said first and second central nodes, respectively.

11. A constant current generator circuit according to claim 10, wherein said first output transistor and said first and second control transistors are N-channel MOS field effect transistors, and wherein said second output transistor and said third and fourth control transistors are P-channel MOS field effect transistors.

12. A constant current generator circuit according to claim 11, wherein all of said transistors have polysilicon gates, and selected ones of said gates are doped differently to produce said different threshold voltages.

13. A constant current generator circuit according to claim 11, wherein said first output transistor and said first control transistor have the same threshold voltage, and wherein said second output transistor and said third control transistor have the same threshold voltage.

* * * * *